US008311842B2

(12) United States Patent
Song et al.

(10) Patent No.: US 8,311,842 B2
(45) Date of Patent: Nov. 13, 2012

(54) METHOD AND APPARATUS FOR EXPANDING BANDWIDTH OF VOICE SIGNAL

(75) Inventors: Geun-Bae Song, Jecheon-si (KR); Min-Sung Kim, Suwon-si (KR); Hee-Jin Oh, Suwon-si (KR); Austin Kim, Seongnam-si (KR); Jae-Bum Kim, Seoul (KR)

(73) Assignee: Samsung Electronics Co., Ltd (KR)

( * ) Notice: Subject to any disclaimer, the term of this patent is extended or adjusted under 35 U.S.C. 154(b) by 754 days.

(21) Appl. No.: 12/041,132

(22) Filed: Mar. 3, 2008

(65) Prior Publication Data

US 2008/0215344 A1 Sep. 4, 2008

(30) Foreign Application Priority Data

Mar. 2, 2007 (KR) ..... 10-2007-0021194

(51) Int. Cl.
*G10L 21/04* (2006.01)

(52) U.S. Cl. ..... 704/503; 704/236; 704/230; 704/223; 704/209; 704/208; 704/205; 370/395.2; 348/384.1

(58) Field of Classification Search ..... 704/23, 704/208, 209, 230, 236, 223, 205; 370/395.2; 348/384.1
See application file for complete search history.

(56) References Cited

U.S. PATENT DOCUMENTS

| | | | | |
|---|---|---|---|---|
| 4,078,154 | A * | 3/1978 | Suzuki et al. | 704/236 |
| 5,285,470 | A * | 2/1994 | Schreiber | 348/384.1 |
| 5,455,888 | A | 10/1995 | Iyengar et al. | |
| 6,931,373 | B1 * | 8/2005 | Bhaskar et al. | 704/230 |
| 7,065,485 | B1 * | 6/2006 | Chong-White et al. | 704/208 |
| 2002/0143527 | A1 * | 10/2002 | Gao et al. | 704/223 |
| 2005/0267741 | A1 * | 12/2005 | Laaksonen et al. | 704/209 |
| 2005/0267763 | A1 | 12/2005 | Ojanpera | |
| 2006/0111150 | A1 | 5/2006 | Klinke et al. | |
| 2006/0171397 | A1 * | 8/2006 | Watkinson | 370/395.2 |
| 2008/0195383 | A1 * | 8/2008 | Shlomot et al. | 704/205 |

FOREIGN PATENT DOCUMENTS

| | | |
|---|---|---|
| KR | 1020040028932 | 4/2004 |
| KR | 1020050089874 | 9/2005 |
| KR | 1020070022338 | 2/2007 |

* cited by examiner

*Primary Examiner* — Michael Colucci
(74) *Attorney, Agent, or Firm* — The Farrell Law Firm, P.C.

(57) ABSTRACT

A method and apparatus for expanding a bandwidth of an input narrowband voice signal is provided. The narrowband voice signal is analyzed separately for each frame, and a Degree of Voicing (DV) and a Degree of Stationary (DS) are calculated depending on the analysis. A Degree of Difficulty of Bandwidth Expansion (DDBWE) of the narrowband voice signal is calculated based on DV and DS. Bandwidth expansion is controlled according to DDBWE.

12 Claims, 4 Drawing Sheets

METHOD AND APPARATUS FOR EXPANDING BANDWIDTH OF VOICE SIGNAL

PRIORITY

This application claims priority under 35 U.S.C. §119(a) to a Korean Patent Application filed in the Korean Intellectual Property Office on Mar. 2, 2007 and assigned Serial No. 2007-21194, the disclosure of which is incorporated herein by reference.

BACKGROUND OF THE INVENTION

1. Field of the Invention

The present invention relates generally to a method and apparatus for expanding a bandwidth of narrowband voice signals, and more particularly, to a method and apparatus for generating expanded-band voice signals by reducing artifacts caused by the bandwidth expansion of the narrowband voice signals.

2. Description of the Related Art

Generally, a human being can hear and recognize a voice ranging over an audible frequency band of 20 hz-20 Khz. The voice is divided into consonants and vowels (voiceless sounds and voiced sounds) according to the lingual characteristic. It is known that the voice has a stationary characteristic for a short interval of 10-30 ms in which the physical characteristics of the vocal tract extending from the vocal cords to the lips, and/or the signal characteristic of the voice, are maintained intact.

The voice is converted into an electric voice signal, and then delivered to another party over a telephone or a mobile communication terminal in the form of an analog signal or a digital signal. In order to transmit/receive the voice signal using an electronic apparatus such as the telephone or the mobile communication terminal, a bandwidth of the transmission/reception voice signal is limited to 300 Hz-3.4 KHz of a minimum-narrowband voice signal that the human being can recognize, due to the capacity limitation of the transmission/reception data. A loss of the voice signal in a lower band (20 Hz-300 Hz) and in an upper band (3.4 KHz-20 KHz) causes degradation of voice signal quality.

Poles of a Linear Predictive Coefficient (LPC) filter for the voice signal, referred to a formant frequencies, represent resonant frequencies caused by the whole or a part of the human vocal tract. The formants are important information in identifying vowels, and are called a first formant, a second formant, a third formant, etc. from the lower frequency. In case of the major vowels, it is possible to identify a difference between the vowels only with the information on the first formant and the second formant. The vowel has more than four formants, and in some cases, more than six formants. However, consonants, such as a fricative sounds or a plosive sounds, only have one or two formant frequencies. This is due to the fact that while a resonant operation for the vowel occurs by the vocal tract, a resonant operation for the consonant mainly occurs in a short interval of the oral tract. The voice generated from a consonant also generally has a high-energy component in the high-frequency band of 3.4 KHz or higher.

In artificial bandwidth expansion, vowel-like signals are definite in their signal characteristics and have a relatively stationary characteristic over a long time interval compared to the consonant, making it is easy to model the vowel signals.

With respect to vowel signals, there is a low possibility that artifacts will occur in estimating information on the expanded band when attempting bandwidth expansions using only information on the narrowband voice signal More specifically, even though active bandwidth expansion is attempted, the occurrence possibility of artifacts is low. However, the consonant-like signals are indefinite in their signal characteristics, have a relatively high-energy component in the high-frequency band, and also have a dynamic characteristic, in that the consonant signals abruptly change with the passage of time. Therefore, it is difficult to model these signals, and there is a high possibility that an error will occur in estimating information on the expanded band when attempting bandwidth expansions using only information on the narrowband voice signal. If active bandwidth expansion is attempted, the occurrence possibility of artifacts increases.

FIG. 1 is a diagram illustrating a structure of a voice signal bandwidth expander.

Referring to FIG. 1, a narrowband voice signal input unit 100 extracts a narrowband LPC from a narrowband signal sampled at 8 KHz, and generates a narrowband excitation signal using the LPC. Next, a bandwidth expander 110 estimates an LPC and a gain of the upper band (for example, 4 KHz-8 KHz) from the narrowband LPC using a codebook mapping method that stores the previously calculated LPC and gain and uses them when necessary. The bandwidth expander 110 generates an excitation signal of the upper band from the narrowband excitation signal using an interpolation method that estimates a value between two particular values. The upper-band signal is synchronized using the generated upper-band LPC, upper-band gain, and upper-band excitation signal. Thereafter, the bandwidth expander 110 adds the synthesized upper-band signal to the original narrowband signal to finally synthesize a voice signal of a broadband (0 Hz-8 KHz), sampled at 16 KHz, thereby performing bandwidth expansion on the narrowband voice signal. Finally, an expanded-band voice signal output unit 120 outputs the expanded voice band.

FIG. 2 is a diagram illustrating a structure of a voice signal bandwidth expander for classifying signal types in a voice signal.

Referring to FIG. 2, a narrowband voice signal input unit 200 extracts a narrowband LPC from a narrowband signal sampled at 8 KHz, and generates a narrowband excitation signal using the narrowband LPC. A signal type classifier 210 classifies characteristics of the input narrowband signals according to their signal types, and for example, classifies the characteristics into the presence/absence and characteristics of background noises, a voiced sound and a voiceless sound, based on the previously input reference values. A type-based bandwidth expander 220 adjusts characteristics of the expanded-band signal expanded from the narrowband signal based on the classified types. An expanded-band voice signal output unit 230 outputs an expanded voice band which is matched to the signal characteristic of the narrowband input signal or the characteristic of the background noise.

FIG. 3 is a diagram illustrating a structure of a voice signal bandwidth expander using a coding bit rate of a voice signal.

Referring to FIG. 3, a coded narrowband voice signal input unit 300 receives a coded narrowband voice signal, and a coding bit rate detector 310 detects a bit rate when the coded narrowband voice signal is a signal coded at a particular bit rate which is a frame unit. An expanded-band energy controller 320 adjusts the characteristic of the entire energy or the partial interval's energy of the expanded band in the narrowband voice signal such that the energies are inversely proportional to the bit rate of the narrowband signal. A decoder 330 decodes the coded narrowband voice signal into the original narrowband voice signal. A bandwidth expander 340 actively performs band expansion on the narrowband signal coded at a high bit rate, which has relatively less coding noises, because the distortion and sound quality reduction possibility of the expanded band because the band expansion is relatively low. However, the bandwidth expander 340 passively performs band expansion on the narrowband signal coded at a low bit rate, which has relatively many coding noises, because the distortion and sound quality reduction possibility of the expanded band due to the band expansion is relatively high.

The bandwidth expander 340 adjusts the entire energy or the partial interval's energy of the expanded band such that the energies are inversely proportional to the bit rate of the narrowband signal, thereby reducing the distortion and sound quality reduction in the expanded band, which may be caused by the coding noises.

An expanded-band voice signal output unit 350 outputs a voice signal that has undergone bandwidth expansion based on the coding noises.

However, in artificial bandwidth expansion of the bandwidth-limited voice signal, even though the above-stated advanced technologies are used, the synthesized expanded-band signal is significantly lower in the sound quality than the original natural sound. In particular, the sound quality deteriorates due to the strength of artifacts generated by the artificial bandwidth expansion.

SUMMARY OF THE INVENTION

The present invention has been made to address at least the above problems and/or disadvantages and to provide at least the advantages described below. Accordingly, an aspect of the present invention provides a method and apparatus for removing artifacts caused by bandwidth expansion of an input narrowband voice signal.

According to one aspect of the present invention, a method for expanding a bandwidth of an input narrowband voice signal is provided. The narrowband voice signal is analyzed separately for each frame, and a Degree of Voicing (DV) and a Degree of Stationary (DS) are calculated depending on the analysis. A Degree of Difficulty of Bandwidth Expansion (DDBWE) of the narrowband voice signal is calculated based on DV and DS. Bandwidth expansion is controlled according to DDBWE.

According to another aspect of the present invention, an apparatus for expanding a bandwidth of an input narrowband voice signal is provided. The apparatus includes a Degree of Difficulty of Bandwidth Expansion (DDBWE) calculator for analyzing the narrowband voice signal separately for each frame, calculating a Degree of Voicing (DV) and a Degree of Stationary (DS) depending on the analysis, and calculating DDBWE of the narrowband voice signal based on DV and DS. The apparatus also includes a bandwidth expander for controlling bandwidth expansion according to DDBWE.

BRIEF DESCRIPTION OF THE DRAWINGS

The above and other aspects, features and advantages of the present invention will become more apparent from the following detailed description when taken in conjunction with the accompanying drawings, in which.

DETAILED DESCRIPTION OF THE PREFERRED EMBODIMENTS

Figure 1:
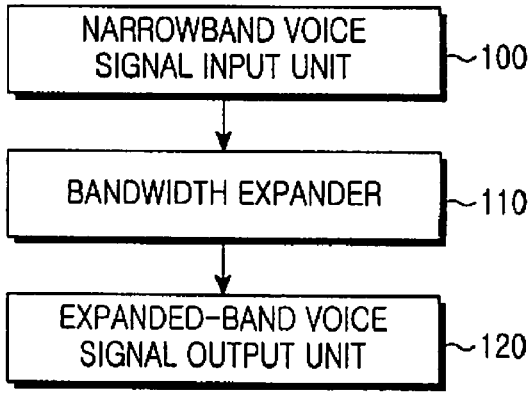
FIG.1 (PRIOR ART)
FIG. 1 is a diagram illustrating a structure of a voice signal bandwidth expander.
Figure 2:
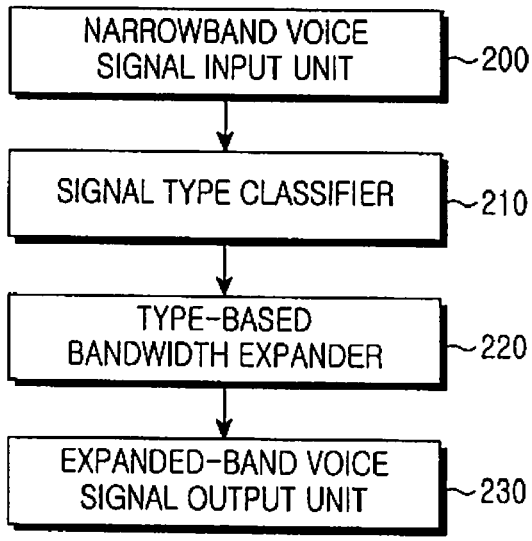
FIG.2 (PRIOR ART)
FIG. 2 is a diagram illustrating a structure of a voice signal bandwidth expander for classifying signal types in a voice signal.
Figure 3:
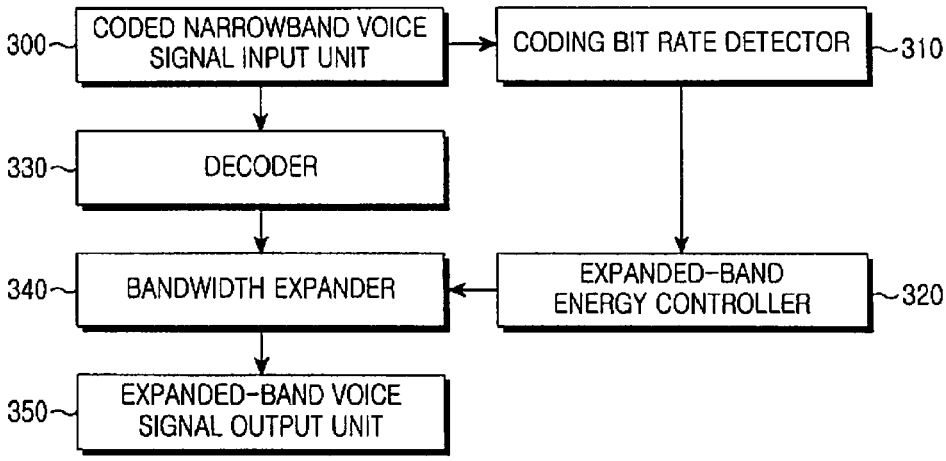
FIG.3 (PRIOR ART)
FIG. 3 is a diagram illustrating a structure of a voice signal bandwidth expander using a coding bit rate of a voice signal.

Preferred embodiments of the present invention are described in detail with reference to the annexed drawings. It should be noted that similar components are designated by similar reference numerals although they are illustrated in different drawings. Detailed descriptions of constructions or processes known in the art may be omitted to avoid obscuring the subject matter of the present invention.

The present invention provides a method and apparatus for expanding a bandwidth of a narrowband voice signal by reducing the strength of artifacts generated in a synthesized expanded-band signal to thereby generate a high-quality voice.

Since the voice is a combination of a voiceless sound (a consonant) and a voiced sound (a vowel), they affect each other by the co-articulation effect between two phonemes, so that the unique signal characteristics of the consonant and the vowel also vary. For example, as the vowel is affected by its adjacent consonant, a variation within approximately 1000 Hz per formant frequency occurs. The transition part, which is the boundary part between the consonant and the vowel, can be considered as an interval where properties of the consonant and the vowel coexist. Therefore, the characteristic of the input voice is presented using the consecutive value, such as a Degree of Voicing (DV) or a Degree of Un-voicing (DU), rather than using the bisectional classification that divides the input voice into a consonant and a vowel. Even for the time-varying characteristic for the voice signal of the input voice, the characteristic of the voice signal is detected in the form of the consecutive value called Degree of Stationary (DS) using a relationship between a previous frame and its succeeding frame, rather than using the bisectional classification that divides the input voice into a statistic signal and a dynamic signal.

In performing bandwidth expansion according to the characteristic of the input voice signal, consecutive parameters DV and DS are extracted from the voice signal, and a parameter called Degree of Difficulty of Bandwidth Expansion (DDBWE) is calculated based on DV and DS. A characteristic of the synthesized expanded-band signal is adjusted according to DDBWE. Herein, a pitch gain can be used as an exemplary criterion indicating DV, and a difference between an LPC coefficient of the current frame and an LPC coefficient of the previous frame can be used as an exemplary criterion indicating DS. A relationship between DDBWE, DV and DS is expressed as Equation (1).

$$DDBWE=f(DV,DS) \quad (1)$$

where f is a function representing a relationship between the independent parameters DV and DS and the dependent parameter DDBWE, and can be a linear or nonlinear form. For example, for DDBWE, a relationship of Equation (2) is given.

$$DDBWE=1-(\alpha DV+(1-\alpha)DS) \quad (2)$$

where $\alpha$ is a weighting parameter, has a value between '0' and '1', and adjusts a ratio of DV and DS in calculating DDBWE. When DV and DS are normalized to a value between '0' and '1' through simple arithmetic manipulation, DDBWE also has a value between '0' and '1'. It can be construed from Equation (2) that as DDBWE approaches '1', the difficulty degree of the bandwidth expansion is higher, and as DDBWE approaches '0', the difficulty degree of the bandwidth expansion is lower. The calculated DDBWE is used for correcting at least one parameter used for expanding the bandwidth. The cut-off frequency for determining the energy or bandwidth of the expanded band can be given as an exemplary bandwidth expansion parameter corrected according to the calculated DDBWE. As DDBWE approaches '1', the expanded-band energy or the expanded-band bandwidth is adjusted to a smaller value. On the contrary, as DDBWE approaches '0', the expanded-band energy or the expanded-band bandwidth is adjusted to a greater value. That is, when DDBWE has a smaller value, active bandwidth expansion is attempted, and when DDBWE has a greater value, passive bandwidth expansion is attempted.

With the use of a structure for adjusting the expanded-band energy synthesized by a bandwidth expander with the calculated DDBWE, a structure for adjusting the expanded-band bandwidth synthesized by the bandwidth expander, or a structure for simultaneously adjusting the synthesized expanded-band energy and the synthesized expanded-band bandwidth, an artifact-reduced voice signal is output.

Figure 4:
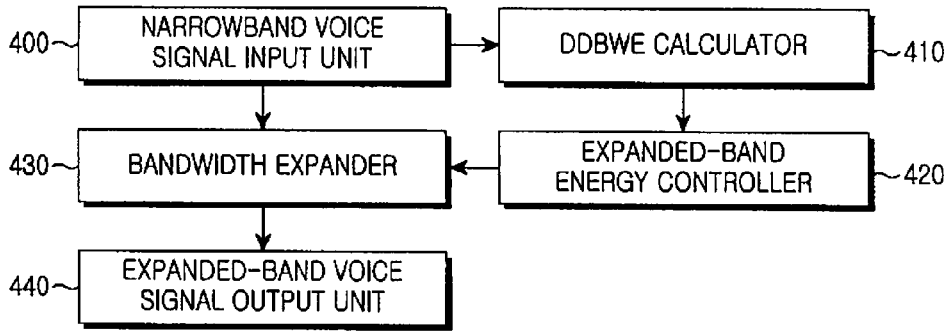
FIG. 4 is a diagram illustrating a structure of a voice signal bandwidth expander based on expanded-band energy control according to an embodiment of the present invention.

FIG. 4 is a diagram illustrating a structure of a voice signal bandwidth expander based on expanded-band energy control according to an embodiment of the present invention.

Referring to FIG. 4, when a narrowband voice signal input unit 400 receives an input voice signal, a DDBWE calculator 410 calculates DDBWE for the input voice signal. An expanded-band energy controller 420 calculates a gain based on DDBWE using Equation (3) to adjust energy of the expanded-band voice signal according to DDBWE, and then multiplies the gain by the expanded-band voice signal.

$$Gain=1-0.75\times DDBWE \quad (3)$$

Since DDBWE has a value between '0' and '1', the gain has a value between '1' and '0.25'. Therefore, when the gain is multiplied by the expanded-band voice signal, the expanded-band energy is reduced by 0 dB to −12 dB. As DDBWE approaches '0', the expanded-band energy is reduced by 0 dB, and as DDBWE approaches '1', the expanded-band energy is reduced by −12 dB.

A bandwidth expander 430 expands a bandwidth of the narrowband voice signal by applying the calculated gain to the expanded-band voice signal. An expanded-band voice signal output unit 440 outputs the expanded voice signal.

Figure 5:
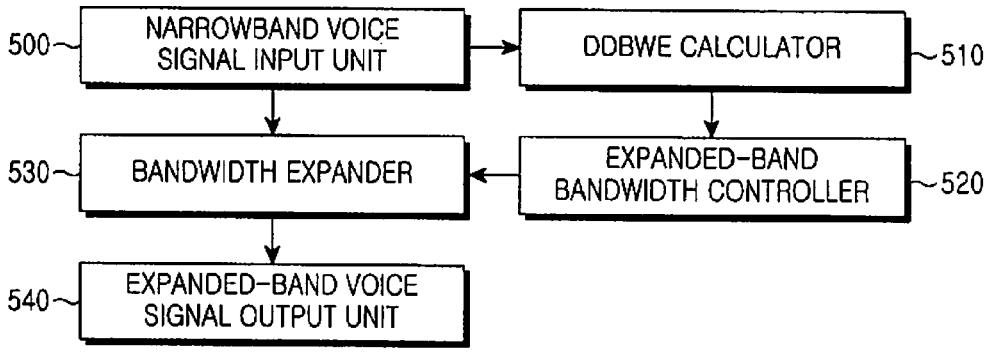
FIG. 5 is a diagram illustrating a structure of a voice signal bandwidth expander based on expanded-band bandwidth control according to an embodiment of the present invention.

FIG. 5 is a diagram illustrating a structure of a voice signal bandwidth expander based on expanded-band bandwidth control according to an embodiment of the present invention.

Referring to FIG. 5, when a narrowband voice signal input unit 500 receives an input voice signal, a DDBWE calculator 510 calculates DDBWE for the input voice signal. An expanded-band bandwidth controller 520 calculates a bandwidth F_bandwidth of the expanded-band voice signal based on DDBWE using Equation (4) to adjust a bandwidth of the expanded-band voice signal according to the calculated DDBWE.

$$F_bandwidth=4000-2000\times DDBWE(Hz) \quad (4)$$

Further, the expanded-band bandwidth controller 520 determines a lower or upper cut-off frequency satisfying the bandwidth, and filters the expanded-band voice signal according to the cut-off frequency. That is, since DDBWE has a value between '0' and '1', the bandwidth F_bandwidth has a value between 4000 Hz and 2000 Hz. In conclusion, as DDBWE approaches '0', the bandwidth of the expanded-band voice signal approaches 4000 Hz, i.e., the maximum bandwidth, and as DDBWE approaches '1', the bandwidth of the expanded-band voice signal becomes 2000 Hz, approaching the minimum bandwidth. A bandwidth expander 530 expands the bandwidth of the narrowband voice signal by applying the calculated bandwidth to the expanded-band voice signal. An expanded-band voice signal output unit 540 outputs the expanded voice signal.

Figure 6:
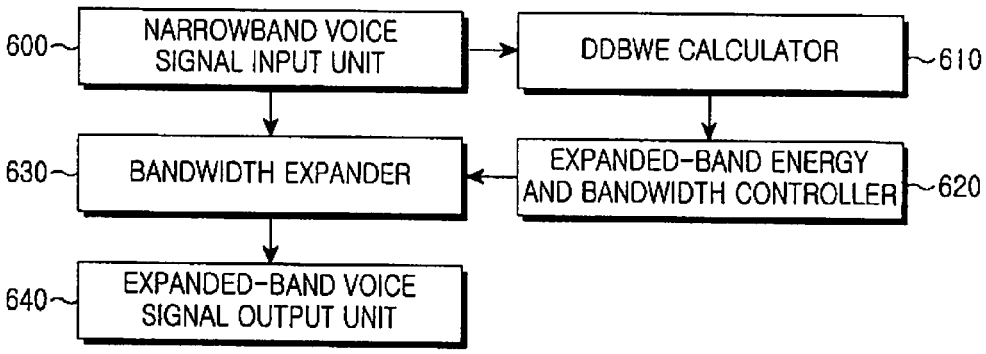
FIG. 6 is a diagram illustrating a structure of a voice signal bandwidth expander based on expanded-band energy control and expanded-band bandwidth control according to an embodiment of the present invention.

FIG. 6 is a diagram illustrating a structure of a voice signal bandwidth expander based on expanded-band energy control and expanded-band bandwidth control according to an embodiment of the present invention.

Referring to FIG. 6, when a narrowband voice signal input unit 600 receives an input voice signal, a DDBWE calculator 610 calculates DDBWE for the input voice signal. An expanded-band energy and bandwidth controller 420 calculates a gain based on DDBWE using Equation (3) to adjust energy of the expanded-band voice signal according to the calculated DDBWE, and calculates the bandwidth F_bandwidth of the expanded-band voice signal based on DDBWE using Equation (4) to adjust the bandwidth of the expanded-band voice signal according to the calculated DDBWE.

A bandwidth expander 630 expands the bandwidth of the narrowband voice signal by applying the calculated gain and the calculated bandwidth to the expanded-band voice signal. That is, the expanded bandwidth is calculated from the input narrowband voice signal through filtering of the gain and the bandwidth. An expanded-band voice signal output unit 640 outputs the expanded voice signal.

Figure 7:
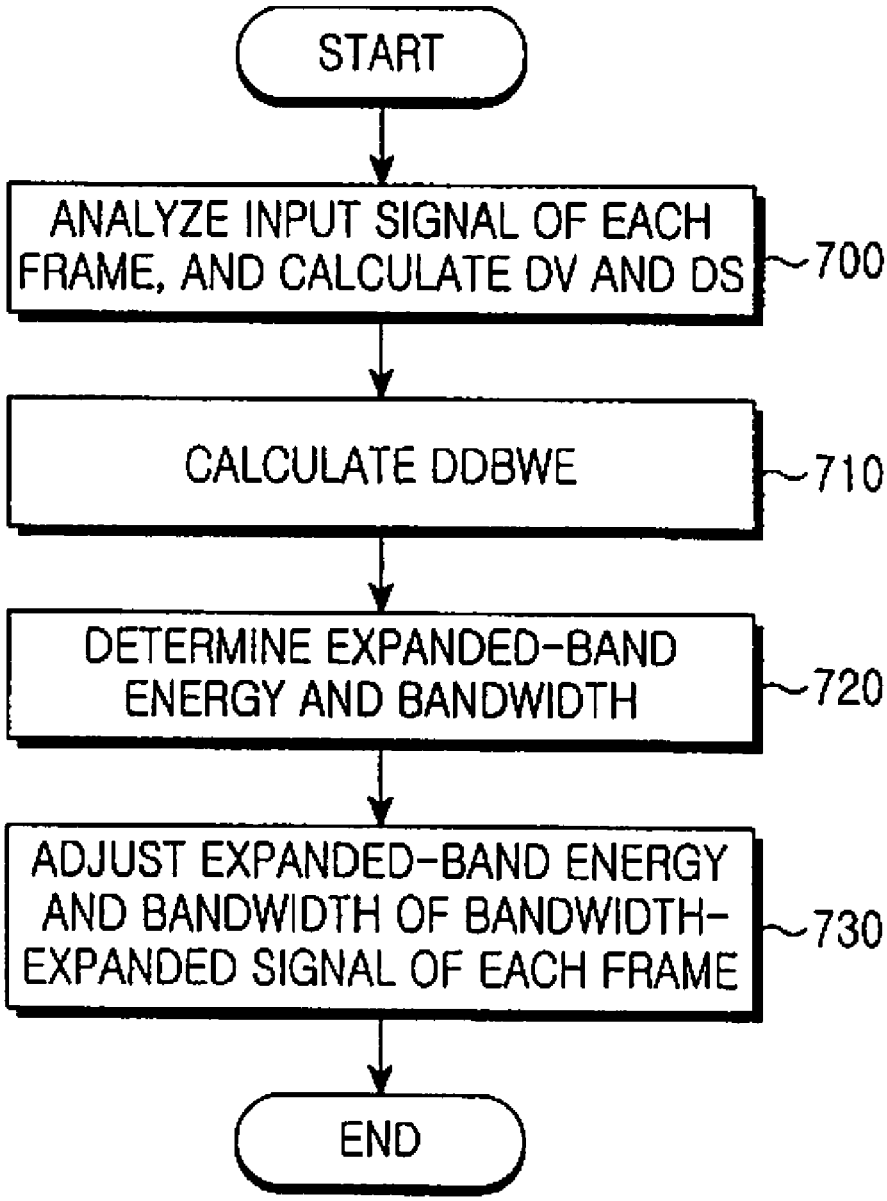
FIG. 7 is a flowchart illustrating a voice signal bandwidth expansion method for a narrowband voice signal according to an embodiment of the present invention.

FIG. 7 is a flowchart illustrating a voice signal bandwidth expansion method for a narrowband voice signal according to an embodiment of the present invention.

Referring to FIG. 7, in step 700, DV and DS are calculated by analyzing an input narrowband voice signal separately for each frame. In step 710, a DDBWE calculator calculates DDBWE of the narrowband voice signal. In step 720, an expanded-band energy controller calculates expanded-band energy of the narrowband voice signal, and an expanded-band bandwidth controller calculates an expanded-band bandwidth of the narrowband voice signal. In step 730, a bandwidth expander adjusts a bandwidth of the narrowband voice signal by applying thereto the expanded-band energy and bandwidth, calculated from the expanded-band energy and bandwidth controller, respectively, as shown in FIG. 6. Alternatively, the bandwidth expander can adjust a bandwidth of the narrowband voice signal by applying thereto the expanded-band energy calculated from the expanded-band energy controller, as shown in FIG. 4. Further alternatively, the bandwidth expander can adjust a bandwidth of the narrowband voice signal by applying thereto the expanded-band bandwidth calculated from the expanded-band bandwidth controller, as shown in FIG. 5.

The present invention is applied to a post-processor (not shown) intervening between a decoder and a Digital-to-Analog (D/A) converter As is apparent from the foregoing description, the present invention expands the bandwidth of the narrowband voice signal by calculating DDBWE and applying the calculated DDBWE, and removes the artifacts by applying the gain and the bandwidth to the expanded-band voice signal. Further, the present invention can remove the artifacts caused by the bandwidth expansion of the narrowband voice signal.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A method for expanding a bandwidth of an input narrowband voice signal, the method comprising the steps of:

analyzing the narrowband voice signal separately for each frame, and calculating a Degree of Voicing (DV) included in the narrowband voice signal and a Degree of Stationary (DS) concerning time-varying characteristic for the narrowband voice signal depending on the analysis;

calculating a Degree of Difficulty of Bandwidth Expansion (DDBWE) of the narrowband voice signal by using a product of DV, a product of DS and a $\alpha$ which is a weighting parameter for adjusting a ratio of DV and DS; and controlling bandwidth expansion adaptively according to DDBWE, wherein DDBWE is defined as a value obtained by subtracting from '1', a sum of the product of DV and $\alpha$ and the product of DS and a value obtained by subtracting $\alpha$ from 1, where $\alpha$ has a value between '0' and '1'.

2. The method of claim 1, further comprising:

calculating an expanded-band energy of the narrowband voice signal according to DDBWE; and controlling bandwidth expansion according to the calculated expanded-band energy of the narrowband voice signal.

3. The method of claim 1, further comprising:

calculating an expanded-band bandwidth of the narrowband voice signal according to DDBWE; and controlling bandwidth expansion according to the calculated expanded-band bandwidth of the narrowband voice signal.

4. The method of claim 1, further comprising:

calculating expanded-band energy and bandwidth of the narrowband voice signal according to DDBWE; and controlling bandwidth expansion according to the calculated expanded-band energy and bandwidth of the narrowband voice signal.

5. The method of claim 1, wherein DV comprises a pitch gain.

6. The method of claim 1, wherein DS comprises a difference between a Linear Predictive Coefficient (LPC) of a current frame and an LPC of a previous frame.

7. An apparatus for expanding a bandwidth of an input narrowband voice signal, the apparatus comprising:

a Degree of Difficulty of Bandwidth Expansion (DDBWE) calculator for analyzing the narrowband voice signal separately for each frame, calculating a Degree of Voicing (DV) included in the narrowband voice signal and a Degree of Stationary (DS) concerning time-varying characteristic for the narrowband voice signal depending on the analysis, and calculating DDBWE of the narrowband voice signal by using a product of DV, a product of DS and a $\alpha$ which is a weighting parameter for adjusting a ratio of DV and DS; and a bandwidth expander for controlling bandwidth expansion adaptively according to DDBWE, wherein DDBWE is defined as a value obtained by subtracting from '1', a sum of the product of DV and $\alpha$ and the product of DS and a value obtained by subtracting $\alpha$ from 1, where $\alpha$ has a value between '0' and '1'.

8. The apparatus of claim 7, further comprising:

an expanded-band energy controller calculating an expanded-band energy of the narrowband voice signal according to DDBWE, wherein the bandwidth expander controls bandwidth expansion according to the calculated expanded-band energy of the narrowband voice signal.

9. The apparatus of claim 7, further comprising:

an expanded-band bandwidth controller for calculating an expanded-band bandwidth of the narrowband voice signal according to DDBWE, wherein the bandwidth expander controls bandwidth expansion according to the calculated expanded-band bandwidth of the narrowband voice signal.

10. The apparatus of claim 7, further comprising:

an expanded-band energy and bandwidth controller for calculating expanded-band energy and bandwidth of the narrowband voice signal according to DDBWE, wherein the bandwidth expander controls bandwidth expansion according to the calculated expanded-band energy and bandwidth of the narrowband voice signal.

11. The apparatus of claim 7, wherein DV comprises a pitch gain.

12. The apparatus of claim 7, wherein DS comprises a difference between a Linear Predictive Coefficient (LPC) of a current frame and an LPC of a previous frame.

* * * * *